US008590644B2

(12) United States Patent
Hall et al.

(10) Patent No.: US 8,590,644 B2
(45) Date of Patent: Nov. 26, 2013

(54) DOWNHOLE DRILL BIT

(75) Inventors: David R. Hall, Provo, UT (US); John D. Bailey, Spanish Fork, UT (US); Ronald B. Crockett, Payson, UT (US)

(73) Assignee: Schlumberger Technology Corporation, Houston, TX (US)

( * ) Notice: Subject to any disclaimer, the term of this patent is extended or adjusted under 35 U.S.C. 154(b) by 1006 days.

(21) Appl. No.: 11/861,641

(22) Filed: Sep. 26, 2007

(65) Prior Publication Data

US 2008/0035387 A1 Feb. 14, 2008

Related U.S. Application Data

(63) Continuation-in-part of application No. 11/829,577, filed on Jul. 27, 2007, which is a continuation-in-part of application No. 11/766,975, filed on Jun. 22, 2007, now Pat. No. 8,122,980, and a continuation-in-part of application No. 11/774,227, filed on Jul. 6, 2007, now Pat. No. 7,669,938, which is a continuation-in-part of application No. 11/773,271, filed on Jul. 3, 2007, now Pat. No. 7,997,661, which is a continuation-in-part of application No. 11/766,903, filed on Jun. 22, 2007, which is a continuation of application No. 11/766,865, filed on Jun. 22, 2007, now abandoned, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, application No. 11/861,641, which is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(51) Int. Cl.
*E21B 10/46* (2006.01)

(52) U.S. Cl.
USPC ..... 175/426; 175/430

(58) Field of Classification Search
USPC ..... 175/426, 428, 4, 31, 430
See application file for complete search history.

(56) References Cited

U.S. PATENT DOCUMENTS 4,315 A 12/1845 Hemming
37,223 A 12/1862 Fosdick (Continued)

FOREIGN PATENT DOCUMENTS

DE 3 307 910 9/1984
DE 3 500 261 7/1986

(Continued)

OTHER PUBLICATIONS

SME Mining Engineering Handbook pp. 691,692; 1992.*

(Continued)

*Primary Examiner* — John Kreck
(74) *Attorney, Agent, or Firm* — Osha Liang LLP

(57) ABSTRACT

In one aspect of the present invention, a drill bit has a body intermediate a shank and a working face. The working face has a plurality of blades converging towards a center of the working face and diverging towards a gauge of the working face. A first blade has at least one pointed cutting element with a carbide substrate bonded to a diamond working end with a pointed geometry at a non-planar interface and a second blade has at least one shear cutting element with a carbide substrate bonded to a diamond working end with a flat geometry.

20 Claims, 10 Drawing Sheets

(56) References Cited

U.S. PATENT DOCUMENTS

| | | | |
|---|---|---|---|
| 465,103 | A | 12/1891 | Wegner |
| 616,118 | A | 12/1898 | Kuhne |
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |
| 1,360,908 | A | 11/1920 | Everson |
| 1,387,733 | A | 8/1921 | Midgett |
| 1,460,671 | A | 7/1923 | Hebsacker |
| 1,544,757 | A | 7/1925 | Hufford et al. |
| 1,821,474 | A | 9/1931 | Mercer |
| 1,879,177 | A | 9/1932 | Gault |
| 2,004,315 | A | 6/1935 | Fean |
| 2,054,255 | A | 9/1936 | Howard |
| 2,064,255 | A | 12/1936 | Garfield |
| 2,121,202 | A | 6/1938 | Killgore |
| 2,124,438 | A | 7/1938 | Struk et al. |
| 2,169,223 | A | 8/1939 | Christian |
| 2,218,130 | A | 10/1940 | Court |
| 2,320,136 | A | 5/1943 | Kammerer |
| 2,466,991 | A | 4/1949 | Kammerer |
| 2,540,464 | A | 2/1951 | Stokes |
| 2,545,036 | A | 3/1951 | Kammerer |
| 2,755,071 | A | 7/1956 | Kammerer |
| 2,776,819 | A | 1/1957 | Brown |
| 2,819,043 | A | 1/1958 | Henderson |
| 2,838,284 | A | 6/1958 | Austin |
| 2,894,722 | A | 7/1959 | Buttolph |
| 2,963,102 | A | 12/1960 | Smith |
| 3,135,341 | A | 6/1964 | Ritter |
| 3,254,392 | A | 6/1966 | Novkov |
| 3,294,186 | A | 12/1966 | Buell |
| 3,301,339 | A | 1/1967 | Pennebaker, Jr. |
| 3,379,264 | A | 4/1968 | Cox |
| 3,397,012 | A | 8/1968 | Krekeler |
| 3,429,390 | A | 2/1969 | Bennett |
| 2,901,223 | A | 8/1969 | Scott |
| 3,493,165 | A | 2/1970 | Schonfeld |
| 3,583,504 | A | 6/1971 | Aalund |
| 3,626,775 | A | 12/1971 | Gentry |
| 3,745,396 | A | 7/1973 | Quintal et al. |
| 3,745,623 | A | 7/1973 | Wentorf, Jr. et al. |
| 3,746,396 | A | 7/1973 | Radd |
| 3,765,493 | A | 10/1973 | Rosar et al. |
| 3,800,891 | A | 4/1974 | White et al. |
| 3,807,804 | A | 4/1974 | Kniff |
| 3,821,993 | A | 7/1974 | Kniff et al. |
| 3,830,321 | A | 8/1974 | McKenry et al. |
| 3,932,952 | A | 1/1976 | Helton |
| 3,945,681 | A | 3/1976 | White |
| 3,955,635 | A | 5/1976 | Skidmore |
| 3,960,223 | A | 6/1976 | Kleine |
| 4,005,914 | A | 2/1977 | Newman |
| 4,006,936 | A | 2/1977 | Crabiel |
| 4,081,042 | A | 3/1978 | Johnson et al. |
| 4,096,917 | A | 6/1978 | Harris |
| 4,098,362 | A | 7/1978 | Bonnice |
| 4,106,577 | A | 8/1978 | Summers |
| 4,109,737 | A | 8/1978 | Bovenkerk |
| 4,140,004 | A | 2/1979 | Smith et al. |
| 4,156,329 | A | 5/1979 | Daniels et al. |
| 4,176,723 | A | 12/1979 | Arceneaux |
| 4,199,035 | A | 4/1980 | Thompson |
| 4,201,421 | A | 5/1980 | Den Besten |
| 4,211,508 | A | 7/1980 | Dill et al. |
| 4,224,380 | A | 9/1980 | Bovenkerk et al. |
| 4,247,150 | A | 1/1981 | Wrulich et al. |
| 4,253,533 | A | 3/1981 | Baker, III |
| 4,268,089 | A | 5/1981 | Spence et al. |
| 4,277,106 | A | 7/1981 | Sahley |
| 4,280,573 | A | 7/1981 | Sudnishnikov et al. |
| 4,304,312 | A | 12/1981 | Larsson |
| 4,307,786 | A | 12/1981 | Evans |
| D264,217 | S | 5/1982 | Prause et al. |
| 4,333,902 | A | 6/1982 | Hara |
| 4,333,986 | A | 6/1982 | Tsuji et al. |
| 4,337,980 | A | 7/1982 | Krekeler |
| 4,390,992 | A | 6/1983 | Judd |
| 4,397,361 | A | 8/1983 | Langford |
| 4,412,980 | A | 11/1983 | Tsuji et al. |
| 4,416,339 | A | 11/1983 | Baker et al. |
| 4,425,315 | A | 1/1984 | Tsuji et al. |
| 4,439,250 | A | 3/1984 | Acharya et al. |
| 4,445,580 | A | 5/1984 | Sahley |
| 4,448,269 | A | 5/1984 | Ishikawa et al. |
| 4,465,221 | A | 8/1984 | Schmidt |
| 4,481,016 | A | 11/1984 | Campbell et al. |
| 4,484,644 | A | 11/1984 | Cook et al. |
| 4,484,783 | A | 11/1984 | Emmerich |
| 4,489,986 | A | 12/1984 | Dziak |
| 4,499,795 | A | 2/1985 | Radtke |
| 4,525,178 | A | 6/1985 | Hall |
| 4,531,592 | A | 7/1985 | Hayatdavoudi |
| 4,535,853 | A | 8/1985 | Ippolito et al. |
| 4,538,691 | A | 9/1985 | Dennis |
| 4,566,545 | A | 1/1986 | Story et al. |
| 4,574,895 | A | 3/1986 | Dolezal et al. |
| 4,599,731 | A | 7/1986 | Ware et al. |
| 4,604,106 | A | 8/1986 | Hall |
| 4,627,503 | A | 12/1986 | Horton |
| 4,636,253 | A | 1/1987 | Nakai et al. |
| 4,636,353 | A | 1/1987 | Seon |
| 4,640,374 | A | 2/1987 | Dennis |
| 4,647,111 | A | 3/1987 | Bronder et al. |
| 4,647,546 | A | 3/1987 | Hall, Jr. et al. |
| 4,650,776 | A | 3/1987 | Cerceau et al. |
| 4,662,348 | A | 5/1987 | Hall et al. |
| 4,664,705 | A | 5/1987 | Horton et al. |
| 4,678,237 | A | 7/1987 | Collin |
| 4,682,987 | A | 7/1987 | Brady et al. |
| 4,684,176 | A | 8/1987 | Den Besten et al. |
| 4,688,856 | A | 8/1987 | Elfgen |
| 4,690,691 | A | 9/1987 | Komanduri |
| 4,694,918 | A | 9/1987 | Hall |
| 4,725,098 | A | 2/1988 | Beach |
| 4,726,718 | A | 2/1988 | Meskin et al. |
| 4,729,440 | A | 3/1988 | Hall |
| 4,729,441 | A | 3/1988 | Peetz et al. |
| 4,729,603 | A | 3/1988 | Elfgen |
| 4,765,419 | A | 8/1988 | Scholz et al. |
| 4,765,686 | A | 8/1988 | Adams |
| 4,765,687 | A | 8/1988 | Parrott |
| 4,776,862 | A | 10/1988 | Wiand |
| 4,815,342 | A | 3/1989 | Brett et al. |
| 4,852,672 | A | 8/1989 | Behrens |
| 4,880,154 | A | 11/1989 | Tank |
| 4,889,017 | A | 12/1989 | Fuller et al. |
| D305,871 | S | 2/1990 | Geiger |
| 4,921,310 | A | 5/1990 | Hedlund et al. |
| 4,932,723 | A | 6/1990 | Mills |
| 4,940,099 | A | 7/1990 | Deane et al. |
| 4,940,288 | A | 7/1990 | Stiffler et al. |
| 4,944,559 | A | 7/1990 | Sionnet et al. |
| 4,944,772 | A | 7/1990 | Cho |
| 4,951,762 | A | 8/1990 | Lundell |
| 4,956,238 | A | 9/1990 | Griffin |
| 4,962,822 | A | 10/1990 | Pascale |
| 4,981,184 | A | 1/1991 | Knowlton et al. |
| 5,007,685 | A | 4/1991 | Beach et al. |
| 5,009,273 | A | 4/1991 | Grabinski |
| 5,011,515 | A | 4/1991 | Frushour |
| 5,027,914 | A | 7/1991 | Wilson |
| 5,038,873 | A | 8/1991 | Jürgens |
| D324,056 | S | 2/1992 | Frazee |
| D324,226 | S | 2/1992 | Frazee |
| 5,088,797 | A | 2/1992 | O'Neill |
| 5,112,165 | A | 5/1992 | Hedlund et al. |
| 5,119,714 | A | 6/1992 | Scott et al. |
| 5,119,892 | A | 6/1992 | Clegg et al. |
| 5,141,063 | A | 8/1992 | Quesenbury |
| 5,141,289 | A | 8/1992 | Stiffler |
| D329,809 | S | 9/1992 | Bloomfield |
| 5,154,245 | A | 10/1992 | Waldenstrom |
| 5,186,268 | A | 2/1993 | Clegg |

(56) References Cited

U.S. PATENT DOCUMENTS 5,186,892 A 2/1993 Pope
5,222,566 A 6/1993 Taylor et al.
5,248,006 A 9/1993 Scott et al.
5,251,964 A 10/1993 Ojanen
5,255,749 A 10/1993 Bumpurs et al.
5,261,499 A 11/1993 Grubb
5,265,682 A 11/1993 Russell et al.
D342,268 S 12/1993 Meyer
5,303,984 A 4/1994 Ojanen
5,304,342 A 4/1994 Hall, Jr. et al.
5,332,051 A * 7/1994 Knowlton ..... 175/430
5,332,348 A 7/1994 Lemelson
5,351,770 A 10/1994 Cawthorne et al.
5,361,859 A 11/1994 Tibbitts
5,374,319 A 12/1994 Stueber et al.
D357,485 S 4/1995 Mattsson et al.
5,410,303 A 4/1995 Comeau et al.
5,417,292 A 5/1995 Polakoff
5,417,475 A 5/1995 Graham et al.
5,423,389 A 6/1995 Warren et al.
5,447,208 A 9/1995 Lund
5,494,477 A 2/1996 Flood et al.
5,507,357 A 4/1996 Hult et al.
D371,374 S 7/1996 Fischer et al.
5,533,582 A 7/1996 Tibbitts
5,535,839 A 7/1996 Brady
5,542,993 A 8/1996 Rabinkin
5,544,713 A 8/1996 Dennis
5,560,440 A 10/1996 Tibbitts
5,568,838 A 10/1996 Struthers et al.
5,653,300 A 8/1997 Lund
5,655,614 A 8/1997 Azar
5,662,720 A 9/1997 O'Tigheamaigh
5,678,644 A 10/1997 Fielder
5,709,279 A 1/1998 Dennis
5,720,528 A 2/1998 Ritchey
5,732,784 A 3/1998 Nelson
5,738,698 A 4/1998 Kapoor et al.
5,794,728 A 8/1998 Palmberg
5,811,944 A 9/1998 Sampayan et al.
5,823,632 A 10/1998 Burkett
5,837,071 A 11/1998 Andersson et al.
5,845,547 A 12/1998 Sollami
5,848,657 A 12/1998 Flood
5,871,060 A 2/1999 Jensen et al.
5,875,862 A 3/1999 Jurewicz
5,884,979 A 3/1999 Latham
5,890,552 A 4/1999 Scott et al.
5,896,938 A 4/1999 Moeny et al.
5,914,055 A 6/1999 Roberts et al.
5,934,542 A 8/1999 Nakamura et al.
5,935,718 A 8/1999 Demo et al.
5,944,129 A 8/1999 Jensen
5,947,215 A 9/1999 Lundell
5,950,743 A 9/1999 Cox
5,957,223 A 9/1999 Doster et al.
5,957,225 A 9/1999 Sinor
5,967,247 A 10/1999 Pessier
5,967,250 A 10/1999 Lund
5,979,571 A 11/1999 Scott et al.
5,992,405 A 11/1999 Sollami
5,992,547 A 11/1999 Caraway et al.
5,992,548 A 11/1999 Silvia et al.
6,000,483 A 12/1999 Jurewicz et al.
6,003,623 A 12/1999 Miess
6,006,846 A 12/1999 Tibbitts et al.
6,018,729 A 1/2000 Zacharia et al.
6,019,434 A 2/2000 Emmerich
6,021,859 A 2/2000 Tibbitts et al.
6,039,131 A 3/2000 Beaton
6,041,875 A 3/2000 Rai et al.
6,044,920 A 4/2000 Massa et al.
6,051,079 A 4/2000 Andersson et al.
6,056,911 A 5/2000 Griffin
6,065,552 A 5/2000 Scott et al.
6,068,913 A 5/2000 Cho et al.
6,095,262 A 8/2000 Chen
6,098,730 A 8/2000 Scott et al.
6,113,195 A 9/2000 Mercier et al.
6,131,675 A 10/2000 Anderson
6,150,822 A 11/2000 Hong et al.
6,170,917 B1 1/2001 Heinrich et al.
6,186,251 B1 2/2001 Butcher
6,193,770 B1 2/2001 Sung
6,196,340 B1 3/2001 Jensen
6,196,636 B1 3/2001 Mills
6,196,910 B1 3/2001 Johnson
6,199,645 B1 * 3/2001 Anderson et al. ..... 175/426
6,199,956 B1 3/2001 Kammerer
6,202,761 B1 3/2001 Forney
6,213,226 B1 4/2001 Eppink et al.
6,216,805 B1 4/2001 Lays et al.
6,220,375 B1 4/2001 Butcher et al.
6,220,376 B1 4/2001 Lundell
6,223,824 B1 5/2001 Moyes
6,223,974 B1 5/2001 Unde
6,257,673 B1 7/2001 Markham et al.
6,258,139 B1 7/2001 Jensen
6,260,639 B1 7/2001 Yong et al.
6,269,893 B1 8/2001 Beaton et al.
6,270,165 B1 8/2001 Peay
6,272,748 B1 8/2001 Smyth
6,290,007 B2 9/2001 Beuershausen et al.
6,290,008 B1 9/2001 Portwood et al.
6,296,069 B1 10/2001 Lamine et al.
6,302,224 B1 10/2001 Sherwood, Jr.
6,302,225 B1 10/2001 Yoshida et al.
6,315,065 B1 11/2001 Yong et al.
6,332,503 B1 12/2001 Pessier et al.
6,340,064 B2 1/2002 Fielder et al.
6,341,823 B1 1/2002 Sollami
6,354,771 B1 3/2002 Bauschulte et al.
6,364,034 B1 4/2002 Schoeffler
6,364,420 B1 4/2002 Sollami
6,371,567 B1 4/2002 Sollami
6,375,272 B1 4/2002 Ojanen
6,375,706 B2 4/2002 Kembaiyan et al.
6,394,200 B1 5/2002 Watson et al.
6,408,052 B1 6/2002 McGeoch
6,408,959 B2 6/2002 Bertagnolli et al.
6,412,560 B1 7/2002 Bernat
6,419,278 B1 7/2002 Cunningham
6,424,919 B1 7/2002 Moran et al.
6,429,398 B1 8/2002 Legoupil et al.
6,435,287 B2 8/2002 Estes
6,439,326 B1 8/2002 Huang et al.
6,460,637 B1 10/2002 Siracki et al.
6,468,368 B1 10/2002 Merrick et al.
6,474,425 B1 11/2002 Truax et al.
6,478,383 B1 11/2002 Ojanen et al.
6,481,803 B2 11/2002 Ritchey
6,484,825 B2 11/2002 Watson et al.
6,484,826 B1 11/2002 Anderson
6,499,547 B2 12/2002 Scott et al.
6,508,318 B1 1/2003 Linden et al.
6,510,906 B1 1/2003 Richert et al.
6,513,606 B1 2/2003 Krueger
6,516,293 B1 2/2003 Huang et al.
6,517,902 B2 2/2003 Drake et al.
6,533,050 B2 3/2003 Molloy
6,561,293 B2 5/2003 Minikus et al.
6,562,462 B2 5/2003 Griffin et al.
D477,225 S 7/2003 Pinnavaia
6,585,326 B2 7/2003 Sollami
6,592,985 B2 7/2003 Griffin et al.
6,594,881 B2 7/2003 Tibbitts
6,596,225 B1 7/2003 Pope et al.
6,601,454 B1 8/2003 Botnan
6,601,662 B2 8/2003 Matthias et al.
6,622,803 B2 9/2003 Harvey et al.
6,668,949 B1 12/2003 Rives
6,672,406 B2 1/2004 Beuershausen
6,685,273 B1 2/2004 Sollami
6,692,083 B2 2/2004 Latham

(56) References Cited

U.S. PATENT DOCUMENTS

| | | | |
|---|---|---|---|
| 6,702,393 | B2 | 3/2004 | Mercier |
| 6,709,065 | B2 | 3/2004 | Peay et al. |
| 6,711,060 | B2 | 3/2004 | Sakakibara |
| 6,719,074 | B2 | 4/2004 | Tsuda et al. |
| 6,729,420 | B2 | 5/2004 | Mensa-Wilmot |
| 6,732,817 | B2 | 5/2004 | Dewey et al. |
| 6,732,914 | B2 | 5/2004 | Cadden et al. |
| 6,733,087 | B2 | 5/2004 | Hall et al. |
| 6,739,327 | B2 | 5/2004 | Sollami |
| 6,749,033 | B2 | 6/2004 | Griffin et al. |
| 6,758,530 | B2 | 7/2004 | Sollami |
| D494,031 | S | 8/2004 | Moore, Jr. |
| D494,064 | S | 8/2004 | Hook |
| 6,786,557 | B2 | 9/2004 | Montgomery, Jr. |
| 6,802,676 | B2 | 10/2004 | Noggle |
| 6,822,579 | B2 | 11/2004 | Goswami et al. |
| 6,824,225 | B2 | 11/2004 | Stiffler |
| 6,846,045 | B2 | 1/2005 | Sollami |
| 6,851,758 | B2 | 2/2005 | Beach |
| 6,854,810 | B2 | 2/2005 | Montgomery, Jr. |
| 6,861,137 | B2 | 3/2005 | Griffin et al. |
| 6,878,447 | B2 | 4/2005 | Griffin |
| 6,879,947 | B1 | 4/2005 | Glass |
| 6,880,744 | B2 | 4/2005 | Noro et al. |
| 6,889,890 | B2 | 5/2005 | Yamazaki et al. |
| 6,929,076 | B2 | 8/2005 | Fanuel et al. |
| 6,933,049 | B2 | 8/2005 | Wan et al. |
| 6,953,096 | B2 | 10/2005 | Gledhill et al. |
| 6,959,765 | B2 | 11/2005 | Bell |
| 6,962,395 | B2 | 11/2005 | Mouthaan |
| 6,966,611 | B1 | 11/2005 | Sollami |
| 6,994,404 | B1 | 2/2006 | Sollami |
| 7,048,081 | B2 | 5/2006 | Smith et al. |
| 7,104,344 | B2 | 9/2006 | Kriesels et al. |
| 7,152,703 | B2 | 12/2006 | Meiners et al. |
| 7,204,560 | B2 | 4/2007 | Mercier et al. |
| 7,207,398 | B2 | 4/2007 | Runia et al. |
| D547,652 | S | 7/2007 | Kerman et al. |
| D560,699 | S | 1/2008 | Omi |
| 7,350,601 | B2 | 4/2008 | Belnap et al. |
| 7,377,341 | B2 | 5/2008 | Middlemiss et al. |
| 7,380,888 | B2 | 6/2008 | Ojanen |
| 7,396,086 | B1 | 7/2008 | Hall et al. |
| 7,543,662 | B2 | 6/2009 | Belnap et al. |
| 7,575,425 | B2 | 8/2009 | Hall et al. |
| 7,592,077 | B2 | 9/2009 | Gates, Jr. et al. |
| 7,647,992 | B2 | 1/2010 | Fang et al. |
| 7,665,552 | B2 | 2/2010 | Hall |
| 7,693,695 | B2 | 4/2010 | Huang et al. |
| 7,703,559 | B2 | 4/2010 | Shen et al. |
| 7,730,977 | B2 | 6/2010 | Achilles |
| 7,757,785 | B2 | 7/2010 | Zhang et al. |
| 7,798,258 | B2 | 9/2010 | Singh et al. |
| 2001/0004946 | A1 | 6/2001 | Jensen |
| 2001/0040053 | A1 | 11/2001 | Beuershausen |
| 2002/0074851 | A1 | 6/2002 | Montgomery, Jr. |
| 2002/0153175 | A1 | 10/2002 | Ojanen |
| 2002/0175555 | A1 | 11/2002 | Mercier |
| 2003/0044800 | A1 | 3/2003 | Connelly et al. |
| 2003/0079565 | A1 | 5/2003 | Liang et al. |
| 2003/0141350 | A1 | 7/2003 | Noro et al. |
| 2003/0213621 | A1 | 11/2003 | Britten et al. |
| 2003/0217869 | A1 | 11/2003 | Snyder et al. |
| 2003/0234280 | A1 | 12/2003 | Cadden et al. |
| 2004/0026132 | A1 | 2/2004 | Hall |
| 2004/0026983 | A1 | 2/2004 | McAlvain |
| 2004/0065484 | A1 | 4/2004 | McAlvain |
| 2004/0155096 | A1 | 8/2004 | Zimmerman et al. |
| 2004/0238221 | A1 | 12/2004 | Runia et al. |
| 2004/0256155 | A1 | 12/2004 | Kriesels |
| 2004/0256442 | A1 | 12/2004 | Gates, Jr. |
| 2005/0044800 | A1 | 3/2005 | Hall |
| 2005/0080595 | A1 | 4/2005 | Huang |
| 2005/0103530 | A1 | 5/2005 | Wheeler et al. |
| 2005/0159840 | A1 | 7/2005 | Lin et al. |
| 2005/0173966 | A1 | 8/2005 | Mouthaan |
| 2005/0263327 | A1 | 12/2005 | Meiners et al. |
| 2006/0032677 | A1 | 2/2006 | Azar et al. |
| 2006/0060391 | A1 | 3/2006 | Eyre et al. |
| 2006/0086537 | A1 | 4/2006 | Dennis |
| 2006/0086540 | A1 | 4/2006 | Griffin |
| 2006/0162969 | A1 | 7/2006 | Belnap et al. |
| 2006/0180354 | A1 | 8/2006 | Belnap et al. |
| 2006/0180356 | A1 | 8/2006 | Durairajan et al. |
| 2006/0186724 | A1 | 8/2006 | Stehney |
| 2006/0237236 | A1 | 10/2006 | Sreshta et al. |
| 2007/0106487 | A1 | 5/2007 | Gavia et al. |
| 2007/0193782 | A1 | 8/2007 | Fang |
| 2007/0221408 | A1 | 9/2007 | Hall et al. |
| 2007/0278017 | A1 | 12/2007 | Shen et al. |
| 2008/0006448 | A1 | 1/2008 | Zhang et al. |
| 2008/0011522 | A1 | 1/2008 | Hall et al. |
| 2008/0053710 | A1 | 3/2008 | Moss |
| 2008/0073126 | A1 | 3/2008 | Shen et al. |
| 2008/0073127 | A1 | 3/2008 | Zhan et al. |
| 2008/0142276 | A1 | 6/2008 | Griffo et al. |
| 2008/0156544 | A1 | 7/2008 | Singh et al. |
| 2008/0206576 | A1 | 8/2008 | Qian et al. |
| 2009/0166091 | A1 | 7/2009 | Matthews et al. |
| 2009/0223721 | A1 | 9/2009 | Dourfaye |

FOREIGN PATENT DOCUMENTS

| | | |
|---|---|---|
| DE | 3 818 213 | 11/1989 |
| DE | 4 039 217 | 6/1992 |
| DE | 19 821 147 | 11/1999 |
| DE | 10 163 717 | 5/2003 |
| EP | 0 295 151 | 6/1988 |
| EP | 0 412 287 | 2/1991 |
| GB | 2 004 315 | 3/1979 |
| GB | 2 037 223 | 7/1980 |
| JP | 5 280 273 | 10/1993 |

OTHER PUBLICATIONS

International search report for PCT/US2007/075670, dated Nov. 17, 2008.

Chaturvedi et al., Diffusion Brazing of Cast Inconel 738 Superalloy, Sep. 2005, Journal of Materials Online (http://www.azom.com/details.asp?ArticleID=2995).

International Report on Patentability Chapter I for PCT/US07/75670, mailed Nov. 17, 2008 (6 pages).

International Preliminary Report on Patentability Chapter II for PCT/US07/75670, completed Aug. 24,2009 (4 pages).

Durrand, et al., Christoper J., Super-hard, Thick, Shaped PDC Cutters for Hard Rock Drilling: Development and Test Results, pp. 1-8, Feb. 3, 2010, Geothermal Reservoir Engineering, Stanford, CA.

Glowka et al., David A., Progress in the Advanced Synthetic-Diamond Drill Bit Program, 1995, pp. 1-9.

Hoch, G. Jeffrey, Is There Room for Geothermal Energy, Innovation: America's Journal of Technology Communication, Dec. 2006/Jan. 2007, pp. 1-3, web print at http://www.innovation-america.org/archive.php? articleID=215.

Jennejohn, Dan, Research and Development in Geothermal Exploration and Drilling, Dec. 2009, pp. 5, 18-19, Geothermal Energy Association, Washington, D.C.

Taylor, Mark A., The State of Geothermal Technology, Part 1: Subsurface Technology, Nov. 2007, pp. 29-30, Geothermal Energy Association for the US Department of Energy, Washington, DC.

US Department of Energy, Geothermal Drilling, Faster and Cheaper is Better, Geothermal Today, May 2000, p. 28, National Technology Information Service, Springfield, VA.

* cited by examiner

DOWNHOLE DRILL BIT

RELATED APPLICATIONS

This application is a continuation-in-part of U.S. patent application Ser. No. 11/829,577, which was filed on Jul. 27, 2007. U.S. patent application Ser. No. 11/829,577 is a continuation-in-part of U.S. patent application Ser. No. 11/766,975 filed on Jun. 22, 2007 and that issued as U.S. Pat. No. 8,122,980 on Feb. 28, 2012. This application is also a continuation-in-part of U.S. patent application Ser. No. 11/774,227 which was filed on Jul. 6, 2007, now U.S. Pat. No. 7,699,938. U.S. patent application Ser. No. 11/774,227 is a continuation-in-part of U.S. patent application Ser. No. 11/773,271 filed on Jul. 3, 2007 and that issued as U.S. Pat. No. 7,997,661 on Aug. 16, 2011. U.S. patent application Ser. No. 11/773,271 is a continuation-in-part of U.S. patent application Ser. No. 11/766,903 filed on Jun. 22, 2007. U.S. patent application Ser. No. 11/766,903 is a continuation of U.S. patent application Ser. No. 11/766,865 filed on Jun. 22, 2007. U.S. patent application Ser. No. 11/766,865 is a continuation-in-part of U.S. patent application Ser. No. 11/742,304 which was filed on Apr. 30, 2007, now U.S. Pat. No. 7,475,948. U.S. patent application Ser. No. 11/742,304 is a continuation of U.S. patent application Ser. No. 11/742,261 which was filed on Apr. 30, 2007, now U.S. Pat. No. 7,469,971. U.S. patent application Ser. No. 11/742,261 is a continuation-in-part of U.S. patent application Ser. No. 11/464,008 which was filed on Aug. 11, 2006, now U.S. Pat. No. 7,338,135. U.S. patent application Ser. No. 11/464,008 is a continuation-in-part of U.S. patent application Ser. No. 11/463,998 which was filed on Aug. 11, 2006, now U.S. Pat. No. 7,384,105. U.S. patent application Ser. No. 11/463,998 is a continuation-in-part of U.S. patent application Ser. No. 11/463,990 which was filed on Aug. 11, 2006, now U.S. Pat. No. 7,320,505. U.S. patent application Ser. No. 11/463,990 is a continuation-in-part of U.S. patent application Ser. No. 11/463,975 which was filed on Aug. 11, 2006, now U.S. Pat. No. 7,445,294. U.S. patent application Ser. No. 11/463,975 is a continuation-in-part of U.S. patent application Ser. No. 11/463,962 which was filed on Aug. 11, 2006, now U.S. Pat. No. 7,413,256. The present application is also a continuation-in-part of U.S. patent application Ser. No. 11/695,672 which was filed on Apr. 3, 2007, now U.S. Pat. No. 7,396,086. U.S. patent application Ser. No. 11/695,672 is a continuation-in-part of U.S. patent application Ser. No. 11/686,831 filed on Mar. 15, 2007, now U.S. Pat. No. 7,568,770. All of these applications are herein incorporated by reference for all that they contain.

BACKGROUND OF THE INVENTION

This invention relates to drill bits, specifically drill bit assemblies for use in oil, gas and geothermal drilling. More particularly, the invention relates to cutting elements in rotary drag bits comprised of a carbide substrate with a non-planar interface and an abrasion resistant layer of superhard material affixed thereto using a high pressure high temperature (HPHT) press apparatus. Such cutting elements typically comprise a superhard material layer or layers formed under high temperature and pressure conditions, usually in a press apparatus designed to create such conditions, cemented to a carbide substrate containing a metal binder or catalyst such as cobalt. A cutting element or insert is normally fabricated by placing a cemented carbide substrate into a container or cartridge with a layer of diamond crystals or grains loaded into the cartridge adjacent one face of the substrate. A number of such cartridges are typically loaded into a reaction cell and placed in the HPHT apparatus. The substrates and adjacent diamond crystal layers are then compressed under HPHT conditions which promotes a sintering of the diamond grains to form the polycrystalline diamond structure. As a result, the diamond grains become mutually bonded to form a diamond layer over the substrate interface. The diamond layer is also bonded to the substrate interface.

Such cutting elements are often subjected to intense forces, torques, vibration, high temperatures and temperature differentials during operation. As a result, stresses within the structure may begin to form. Drag bits for example may exhibit stresses aggravated by drilling anomalies during well boring operations such as bit whirl or bounce often resulting in spalling, delamination or fracture of the superhard abrasive layer or the substrate thereby reducing or eliminating the cutting elements efficacy and decreasing overall drill bit wear life. The superhard material layer of a cutting element sometimes delaminates from the carbide substrate after the sintering process as well as during percussive and abrasive use. Damage typically found in drag bits may be a result of shear failures, although non-shear modes of failure are not uncommon. The interface between the superhard material layer and substrate is particularly susceptible to non-shear failure modes due to inherent residual stresses.

U.S. Pat. No. 6,332,503 to Pessier et al., which is herein incorporated by reference for all that it contains, discloses an array of chisel-shaped cutting elements mounted to the face of a fixed cutter bit, each cutting element has a crest and an axis which is inclined relative to the borehole bottom. The chisel-shaped cutting elements may be arranged on a selected portion of the bit, such as the center of the bit, or across the entire cutting surface. In addition, the crest on the cutting elements may be oriented generally parallel or perpendicular to the borehole bottom.

U.S. Pat. No. 6,059,054 to Portwood et al., which is herein incorporated by reference fir all that it contains, discloses a cutter element that balances maximum gage-keeping capabilities with minimal tensile stress induced damage to the cutter elements is disclosed. The cutter elements of the present invention have a nonsymmetrical shape and may include a more aggressive cutting profile than conventional cutter elements. In one embodiment, a cutter element is configured such that the inside angle at which its leading face intersects the wear face is less than the inside angle at which its trailing face intersects the wear face. This can also be accomplished by providing the cutter element with a relieved wear face. In another embodiment of the invention, the surfaces of the present cutter element are curvilinear and the transitions between the leading and trailing faces and the gage face are rounded, or contoured. In this embodiment, the leading transition is made sharper than the trailing transition by configuring it such that the leading transition has a smaller radius of curvature than the radius of curvature of the trailing transition. In another embodiment, the cutter element has a chamfered trailing edge such that the leading transition of the cutter element is sharper than its trailing transition. In another embodiment, the cutter element has a chamfered or contoured trailing edge in combination with a canted wear face. In still another embodiment, the cutter element includes a positive rake angle on its leading edge.

BRIEF SUMMARY OF THE INVENTION

In one aspect of the present invention, a drill bit has a body intermediate a shank and a working face. The working face has a plurality of blades converging towards a center of the working face and diverging towards a gauge of the working face. A first blade has at least one pointed cutting element with a carbide substrate bonded to a diamond working end with a pointed geometry at a non-planar interface and a second blade has at least one shear cutting element with a carbide substrate bonded to a diamond working end with a flat geometry.

The carbide substrate bonded to the pointed geometry diamond working may have a tapered geometry. A plurality of first blades having the at least one pointed cutting element may alternate with a plurality of second blades having the at least one shear cutting element. A plurality of cutting elements may be arrayed along any portion of their respective blades including a cone portion, nose portion, flank portion, gauge portion, or combinations thereof. When the first and second blades are superimposed on each other, an axis of the at least one pointed cutting element may be offset from an axis of the at least one shear cutting element. An apex of the pointed cutting element may have a 0.050 to 0.200 inch radius. The diamond working en of the pointed cutting element may have a 0.090 to 0.500 inch thickness from the apex to the non-planar interface. A central axis of the pointed cutting element may be tangent to its intended cutting path during a downhole drilling operation. In other embodiments, the central axis of the pointed cutting element may be positioned at an angle relative to its intended cutting path during a downhole drilling operation. The angle of the at least one pointed cutting element on the first blade may be offset from an angle of the at least one shear cutting element on the second blade. A pointed cutting element on the first blade may be oriented at a different angle than an adjacent pointed cutting element on the same blade. The pointed cutting element and the shear cutting element may have different rake angles. The pointed cutting element may generally comprise a smaller rake angle than the shear cutting element. A first pointed cutting element may be located further from the center of the working face than a first shear cutting element. The carbide substrate of the pointed cutting element may be disposed within the first blade. The non-planar interface of the shear cutting element may comprise at least two circumferentially adjacent faces, outwardly angled from a central axis of the substrate.

DETAILED DESCRIPTION EXEMPLARY EMBODIMENTS

Figure 1:
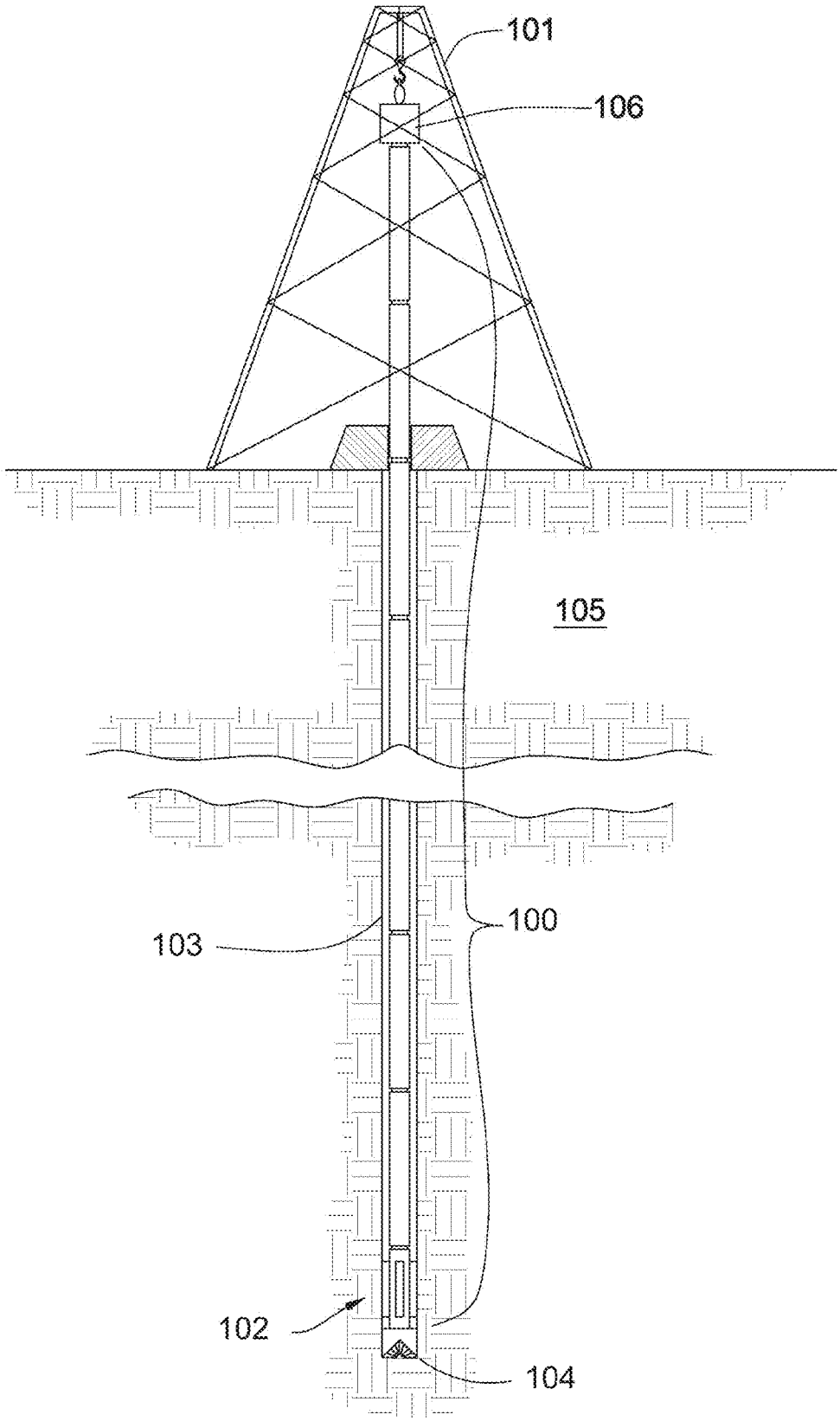
FIG. 1 is a perspective diagram of an embodiment of a drill string suspended in a wellbore.

FIG. 1 is a perspective diagram of an embodiment of a drill string 100 suspended by a derrick 101. A bottom-hole assembly 102 is located at the bottom of a wellbore 103 and comprises a drill bit 104. As the drill bit 104 rotates downhole the drill string 100 advances farter into the earth. The drill string 100 may penetrate soft or hard subterranean formations 105. The drill bit 104 may break up the formations 105 by cutting and/or chipping the formation 105 during a downhole drilling operation. The bottom-hole assembly 102 and/or downhole components may comprise data acquisition devices which may gather data. The data may be sent to the surface via a transmission system to a data swivel 106. The data swivel 106 may send the data to the surface equipment. Further, the surface equipment may send data and/or power to downhole tools and/or the bottom-hole assembly 102. U.S. Pat. No. 6,670,880 which is herein incorporated by reference for all that it contains, discloses a telemetry system that may be compatible with the present invention; however, other forms of telemetry may also be compatible such as systems that include mud pulse systems, electromagnetic waves, radio waves, and/or short hop. In some embodiments, no telemetry system is incorporated into the drill string.

Figure 2:
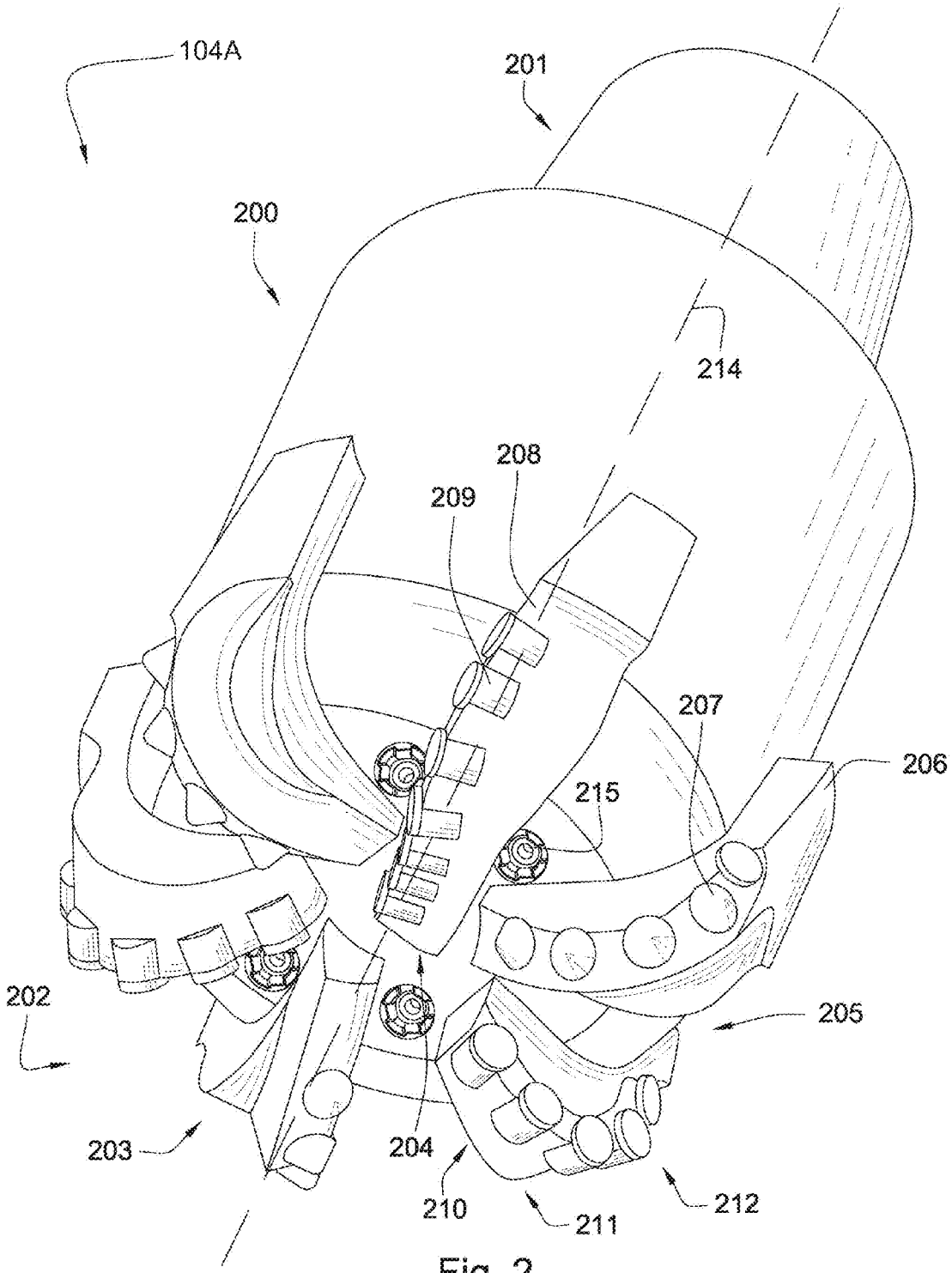
FIG. 2 is a perspective diagram of an embodiment of a drill bit.

In the embodiment of FIG. 2, the drill bit 104A has a body 200 intermediate a shank 201 and a working face 202; the working face 202 having a plurality of blades 203 converging towards a center 204 of the working face 202 and diverging towards a gauge portion 205 of the working face 202. A first blade 206 may have at least one pointed cutting element 207 and a second blade 208 may have at least one shear cutting element 209. In the preferred embodiment, a plurality of first blades 206 having the at least one pointed cutting element 207 may alternate with a plurality of second blades 208 having the at least one shear cutting element 209. A carbide substrate of the pointed cutting element 207 may be disposed within the first blade 206.

Also in this embodiment, a plurality of cutting elements 207, 209, may be arrayed along any portion of their respective blades 206, 208, including a cone portion 210, nose portion 211, flank portion 212, gauge portion 205, or combinations thereof.

Also shown in FIG. 2, a plurality of nozzles 215 may be disposed into recesses formed in the working face 202. Each nozzle 215 may be oriented such that a jet of drilling mud ejected from the nozzles 215 engages the formation before or after the cutting elements 207, 209. The jets of drilling mud may also be used to clean cuttings away from the drill bit 104. The drill bit 104A may be intended for deep oil and gas drilling, although any type of drilling application is anticipated such as horizontal drilling, geothermal drilling, exploration, on and off-shore drilling, directional drilling, water well drilling and any combination thereof.

Figure 3:
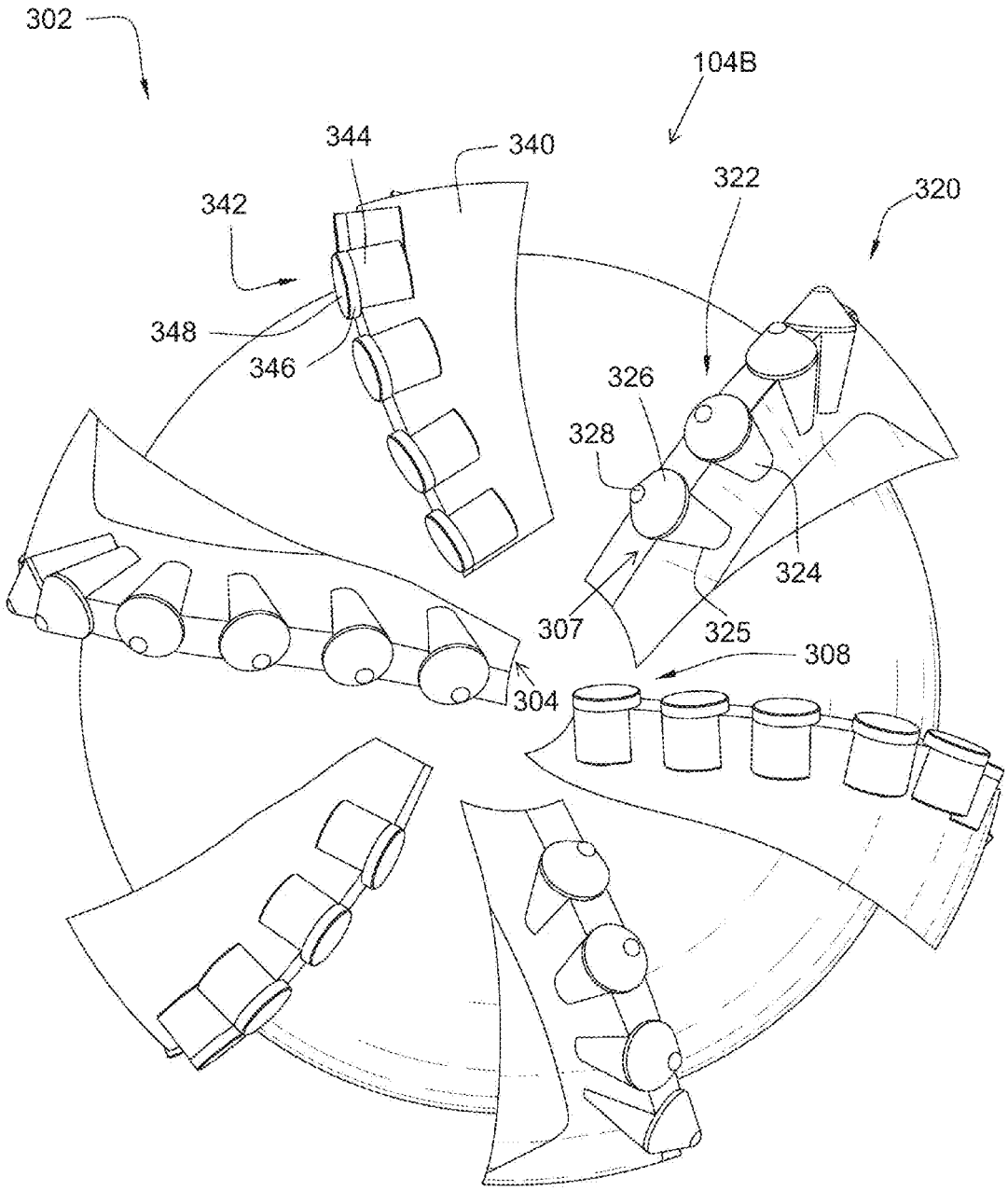
FIG. 3 is an orthogonal diagram of another embodiment of a drill bit.

Referring now to another embodiment of the drill bit 104B illustrated in FIG. 3, the first blade 320 comprises at least one pointed cutting element 322 with a first carbide substrate 324 bonded to a diamond working end 326 with a pointed geometry 328. The second blade 340 comprises at least one shear cutting element 342 with a second carbide substrate 344 bonded to a diamond working end 346 with a flat geometry 348. The first carbide substrate 324 bonded to the pointed geometry diamond working end 326 may have a tapered geometry 325. In this embodiment, a first pointed cutting element 307 may be farther from the center 304 of the working face 302 than a first shear cutting element 308.

Figure 4:
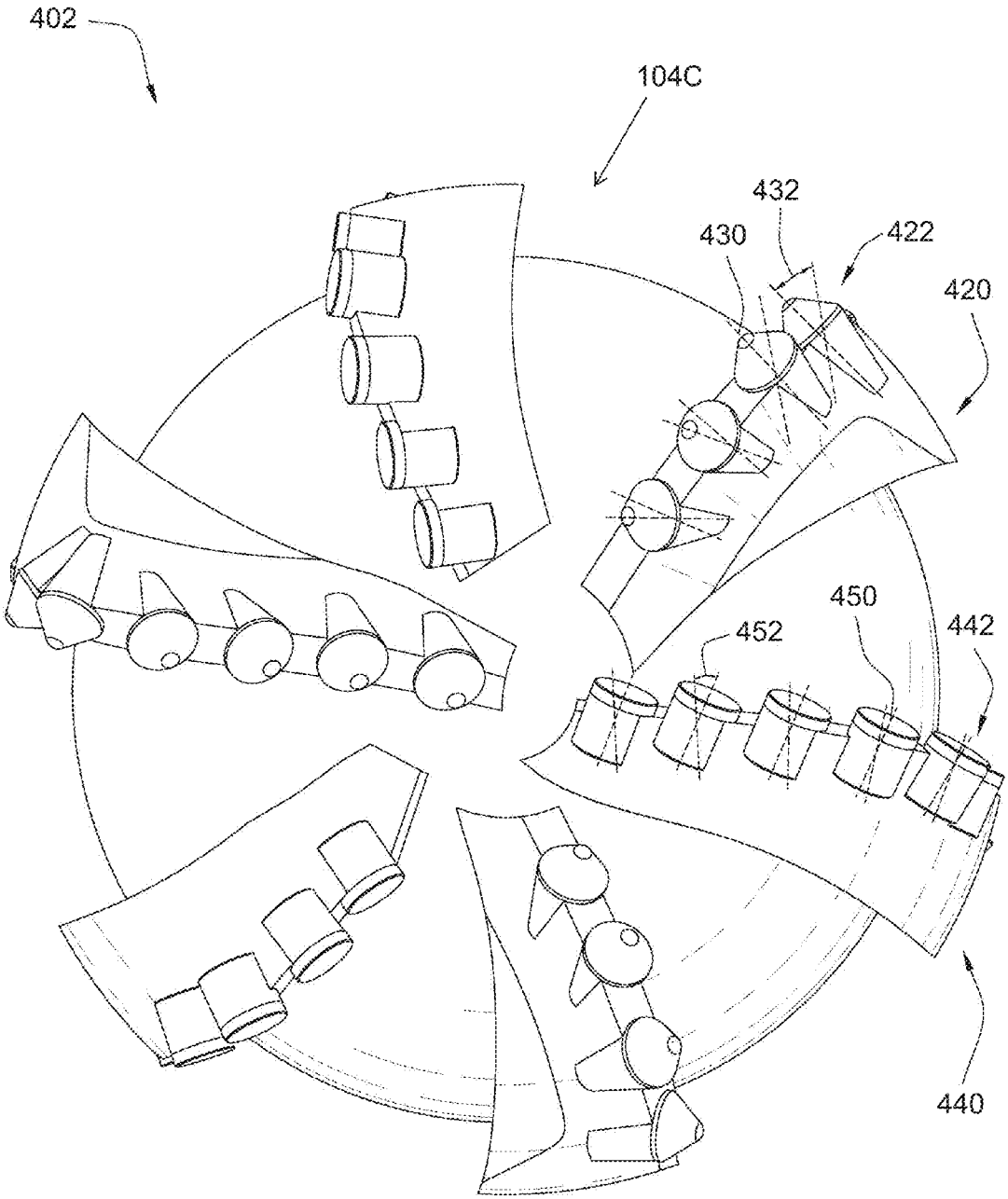
FIG. 4 is an orthogonal diagram of another embodiment of a drill bit.

Referring now to another embodiment of the drill bit 104C illustrated in FIG. 4, a central axis 430 of the pointed cutting element 422 may be positioned at an angle 432 (e.g. side rake, as known to one of skill in the art) relative to a cutting path formed by the working face 402 of the drill bit during a downhole drilling operation. Furthermore, the angle 432 (or side rake) of at least one pointed cutting element 422 on the first blade 420 may be offset from an angle 452 (or side rake) of at least one shear cutting element 442 on the second blade 440 having a central axis 450 positioned at the angle 452 relative to a cutting path. This orientation may be beneficial in that one blade having all its cutting elements at a common angle relative to a cutting path may offset cutting elements on another blade having another common angle. This may result in a more efficient drilling operation.

Figure 5:
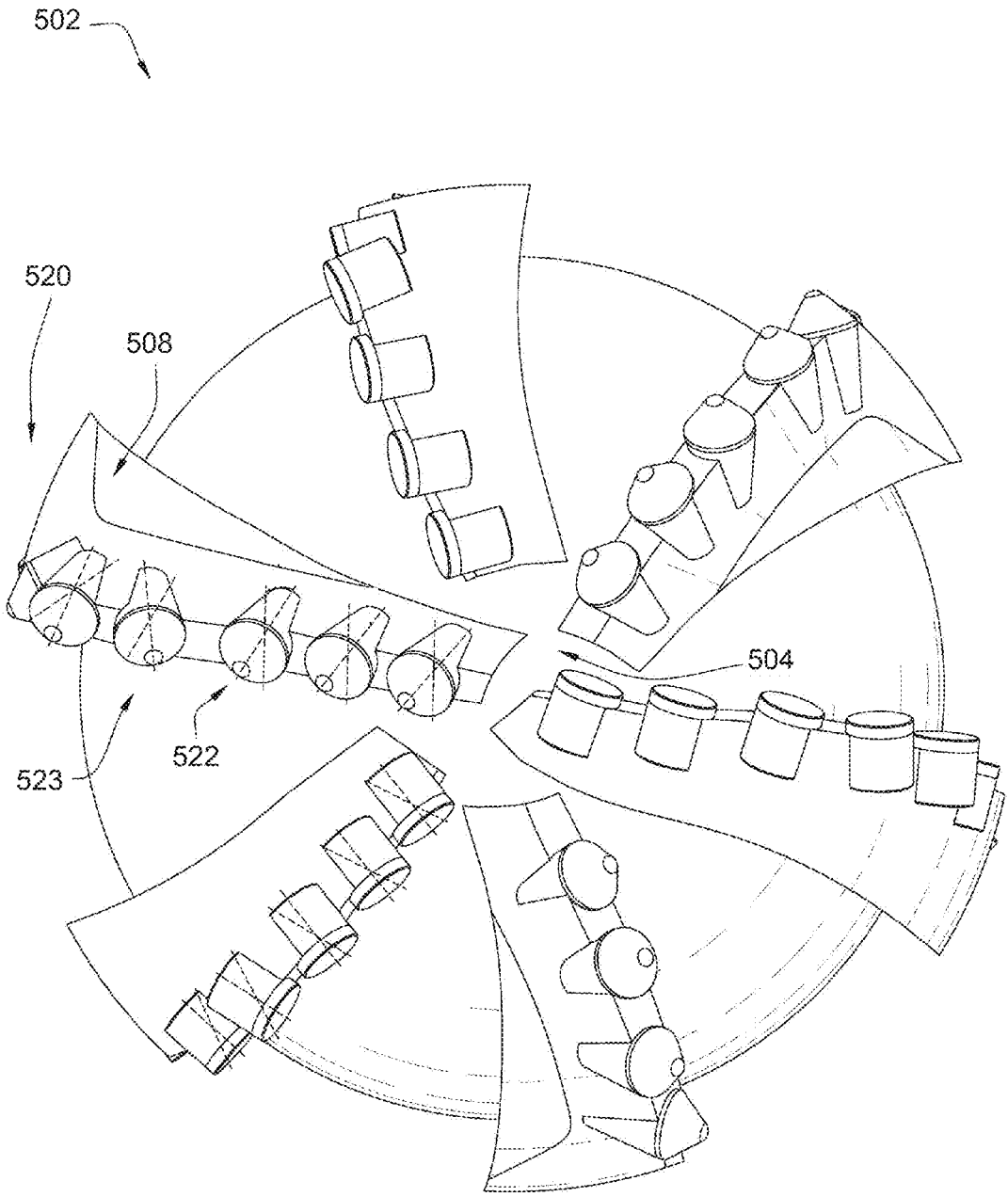
FIG. 5 is an orthogonal diagram of another embodiment of a drill bit.

In the embodiment of the drill bit 104D shown in FIG. 5, the pointed cutting element 522 on the first blade 520 may be oriented at a different angle (side rake) than an adjacent pointed cutting element 523 on the same blade 520. In this embodiment, the pointed cutting elements 522 on the blade 520 nearest the center 504 of the working face 502 may be angled away from a center of the intended circular cutting path, while the pointed cutting elements 523 nearest the gauge portion 508 of the working face 502 may be angled toward the center of the cutting path. This may be beneficial in that cuttings may be forced away from the center 504 of the working face 502 and thereby may be more easily carried to the top of the wellbore.

Figure 6:
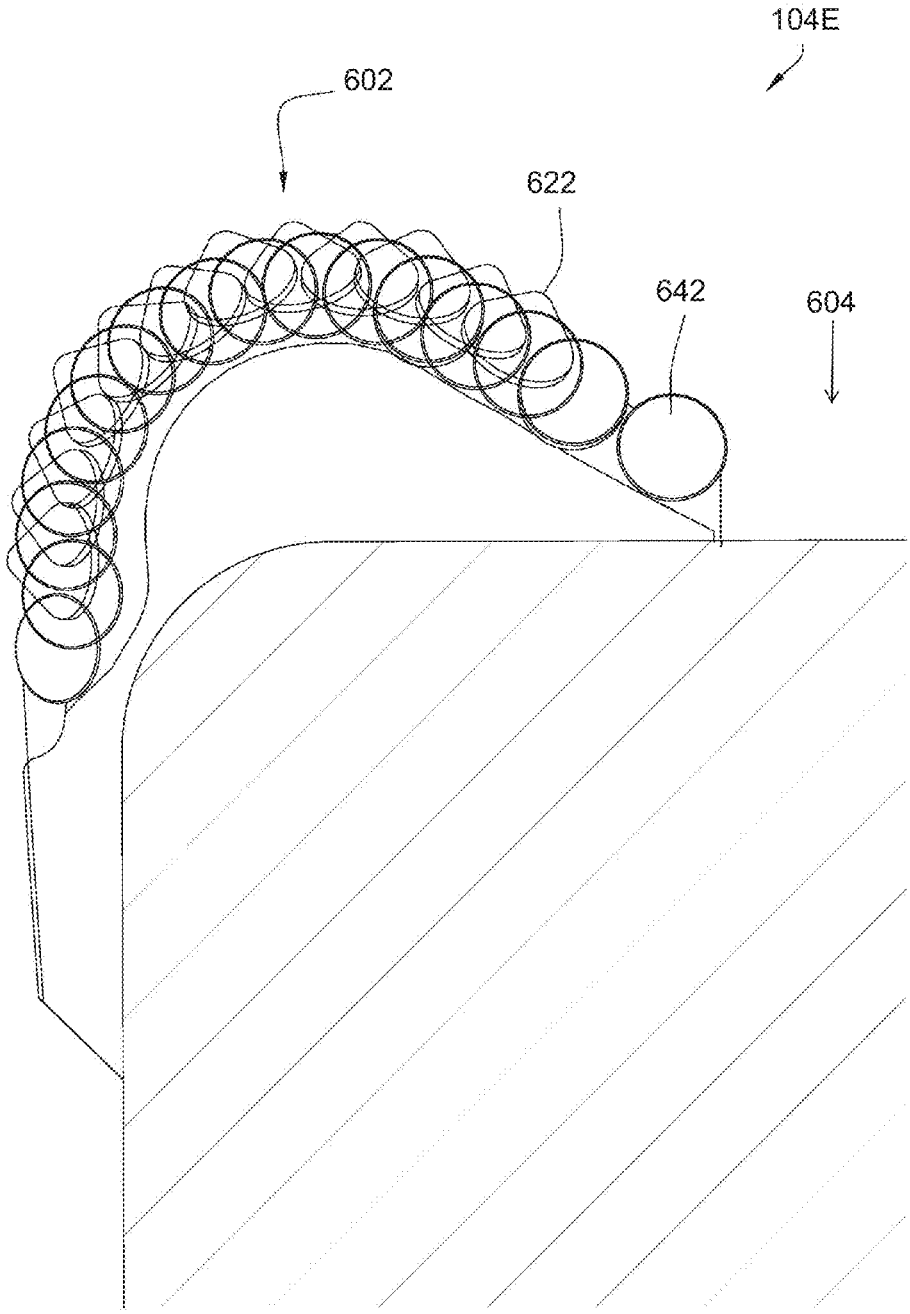
FIG. 6 is a sectional side diagram of an embodiment of a drill bit with a plurality of blades superimposed on one another.

FIG. 6 is a schematic drawing illustrating one embodiment of the drill bit 104E having the plurality of blades graphically superimposed on one another. A plurality of pointed cutting elements 622 on a first blade and a plurality of shear cutting elements 642 on a second blade may comprise different intended cutting paths so that the drilling operation may have an increase in efficiency than if the cutting elements had the same cutting paths. Having cutting elements positioned on the blades at different cutting paths, or radially offset from one another, may break up the formation more quickly and efficiently. As shown in this embodiment, the pointed cutting elements on a first blade may also have a different intended cutting path than the pointed cutting elements on another blade. The shear cutting elements on a second blade may also have a different intended cutting path than the shear cutting elements disposed on another blade. In this embodiment, an innermost shear cutting element 642 may be closer to the center 604 of the working face 602 than an innermost pointed cutting element 622.

Figure 7:
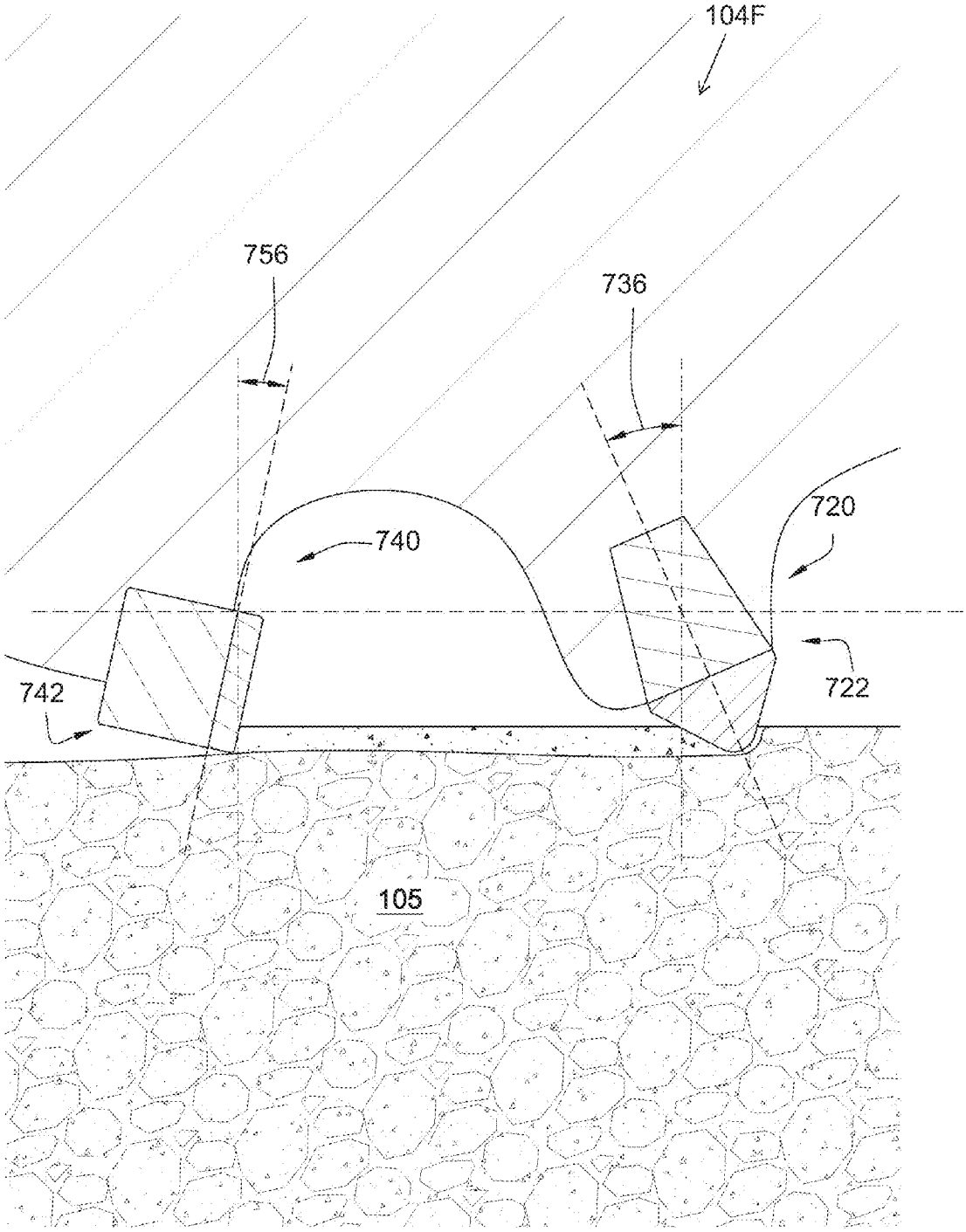
FIG. 7 is a cross-sectional diagram of an embodiment of a plurality of cutting elements positioned on a drill bit.

Referring now to FIG. 7, illustrated therein is another embodiment of the drill bit 104F having a shear cutting element 742 on a second blade 740 orientated at a negative rake angle 756, whereas a pointed cutting element 722 on a first blade 720 is orientated at a positive rake angle 736. It may be beneficial that cutting elements 722, 742 on adjacent blades 720, 740, respectively, have opposite rake angles such that the formation 105 may be more easily cut and removed. In this embodiment, the pointed cutting element 722 may plow through the formation 105 causing the cut formation to build up around the pointed cutting element. The shear cutting element 742, being radially offset from the pointed cutting element 722, may then easily remove the built up formation.

Figure 8:
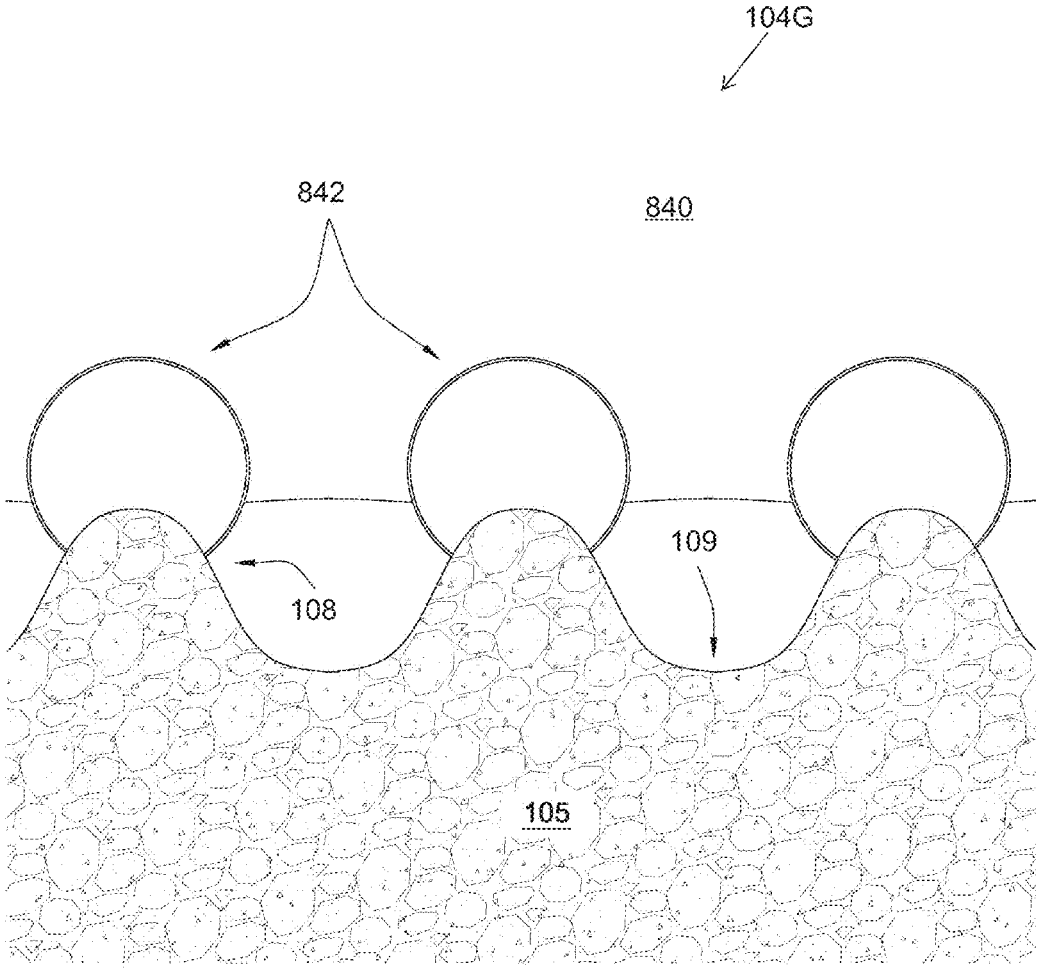
FIG. 8 is a cross-sectional diagram of another embodiment of a plurality of cutting elements positioned on a drill bit.

In the embodiment of the drill bit 104G illustrated in FIG. 8, a plurality of shear cutting elements 842 may be positioned on a second blade 840 such that as the drill bit rotates and its blades follow an intended cutting path, the shear cutting elements 842 may remove mounds of the formation 105 formed by a plurality of pointed cutting elements on an adjacent blade; the pointed cutting elements having plowed through a relatively soft formation 105 forming mounds 108 and valleys 109 during a drilling operation. This may be beneficial so that the formation may be evenly cut and removed downhole. It is believe that in harder formations, the pointed cutting elements will fracture the rock verses displacing it into mounds.

Figure 9:
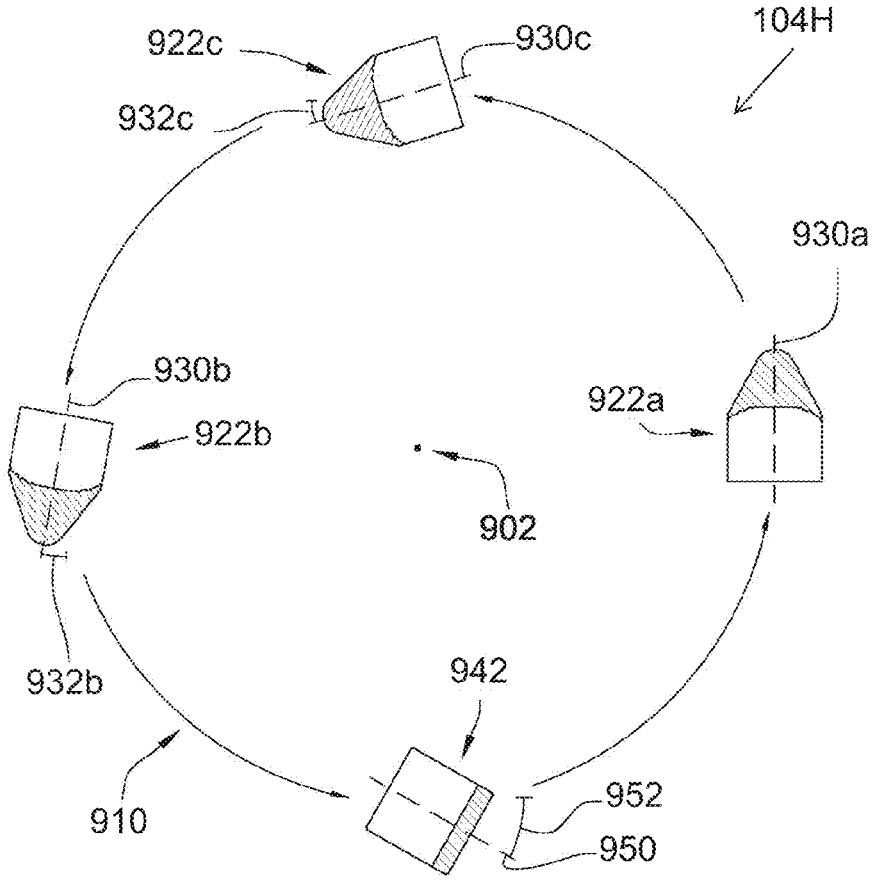
FIG. 9 is a representation of an embodiment pattern of a cutting element.

Referencing yet another representative embodiment of the drill bill 104H, FIG. 9 illustrates a central axis 930*a* of a pointed cutting element 922*a* tangent to an intended cutting path 910 formed by the working face of the drill bit during a downhole drilling operation. The central axis 930*b* of another pointed cutting element 922*b* may be angled away from a center 902 of the cutting path 910. The central axis 930*b* of the angled pointed cutting element 922*b* may form a smaller angle 932*b* with the cutting path 910 than an angle 952 formed by the central axis 920 and the cutting path 910 of an angled shear cutting element 942. In other embodiments, the central axis 930*c* of another pointed cutting element 922*c* may form an angle 932*c* with the cutting path 910 such that the cutting element 922*c* angles towards the center 902 of the cutting path 910.

Figure 10:
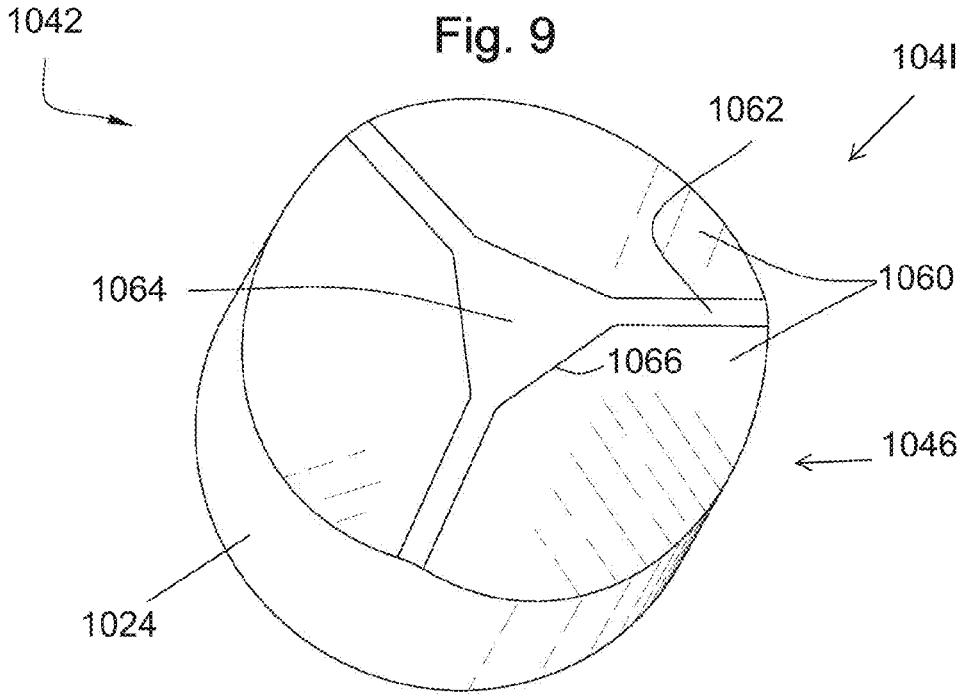
FIG. 10 is a perspective diagram of an embodiment of a carbide substrate.

In the embodiment 1041 of FIG. 10, the non-planar interface of a shear cutting element 1042 may have a diamond working end 1046 including at least two circumferentially adjacent diamond working surfaces 1060, each angled outwardly and downwardly from a central axis of the second carbide substrate 1044. In this embodiment, the carbide substrate 1044 may comprise a junction 1062 between adjacent working surfaces 1060; the junction 1062 having a radius of 0.060 to 0.140 inch. Another junction 1066 between a flatted portion 1064 and each working surface 1060 may comprise a radius of 0.055 to 0.085 inch. When the shear cutting element 1042 is worn, it may be removed from the blade of the drill bit (not shown), rotated, re-attached such that another working surface 1060 is presented to the formation. This may allow for the bit to continue degrading the formation and effectively increase its working life. In this embodiment, the working surfaces 1060 may have equal areas. However, in other embodiments the working surfaces may comprise different areas.

Figure 11:
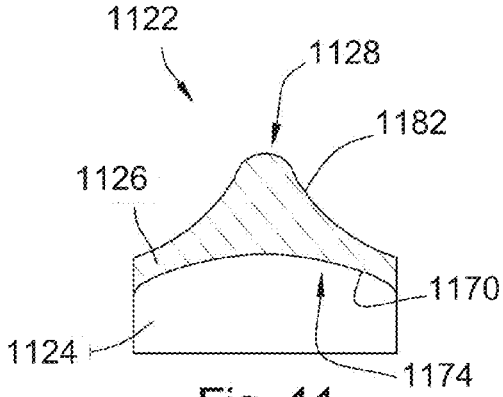
FIG. 11 is a cross-sectional diagram of an embodiment of a pointed cutting element.

FIGS. 11 through 18 show various embodiments of a pointed cutting element with a diamond working end bonded to a carbide substrate, and with the diamond working end having a tapered outer surface and a pointed geometry. For example, FIG. 11 illustrates a pointed cutting element 1122 with a pointed geometry 1128 having a concave outer surface 1182 and a continuous convex geometry 1172 at an interface 1170 between the substrate 1124 and the diamond working end 1126.

Figure 12:
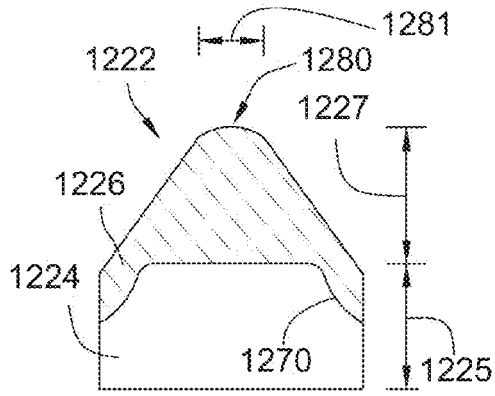
FIG. 12 is a cross-sectional diagram of another embodiment of a pointed cutting element.

FIG. 12 comprises an embodiment of a thicker diamond working end from the apex 1280 to the non-planar interface 1270, while still maintaining a radius 1281 of 0.050 to 0.200 inch. The diamond working end 1226 may comprise a thickness 1227 of 0.050 to 0.500 inch. The carbide substrate 1224 may comprise a thickness 1225 of 0.200 to 1 inch from a base of the carbide substrate to the non-planar interface 1270.

Figure 13:
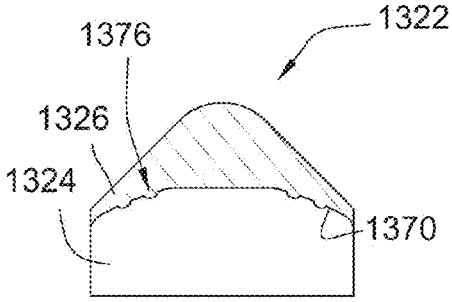
FIG. 13 is a cross-sectional diagram of another embodiment of a pointed cutting element.

FIG. 13 illustrates grooves 1376 formed in the substrate 1324. It is believed that the grooves 1376 may help to increase the strength of the pointed cutting element 1322 at the interface 1370 between the carbide substrate 1324 and the diamond working end 1326.

Figure 14:
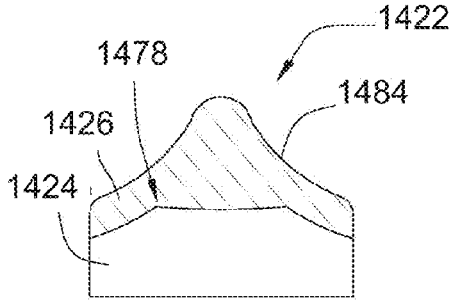
FIG. 14 is a cross-sectional diagram of another embodiment of a pointed cutting element.

FIG. 14 illustrates a pointed cutting element 1422 having a slightly concave geometry 1478 at the interface 1470 between the carbide substrate 1424 and the diamond working end 1426, and with the diamond working end 1426 a concave outer surface 1484.

Figure 15:
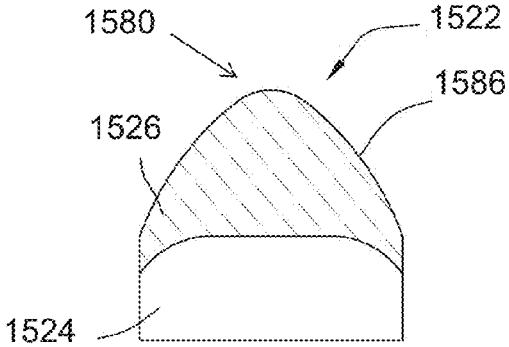
FIG. 15 is a cross-sectional diagram of another embodiment of a pointed cutting element.

FIG. 15 discloses a pointed cutting element 1522 having a diamond working end 1526 with a slightly convex outer surface 1586 of the pointed geometry while still maintaining a 0.050 to 0.200 inch radius at the apex 1580.

Figure 16:
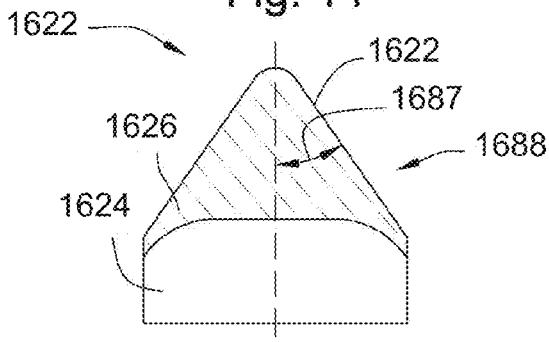
FIG. 16 is a cross-sectional diagram of another embodiment of a pointed cutting element.

FIG. 16 discloses a pointed cutting element 1622 having a diamond working end 1526 having a flat sided pointed geometry 1528. In some embodiments, an outer surface 1688 and a central axis of the diamond working end 1626 may generally form a 35 to 45 degree included angle 1687.

Figure 17:
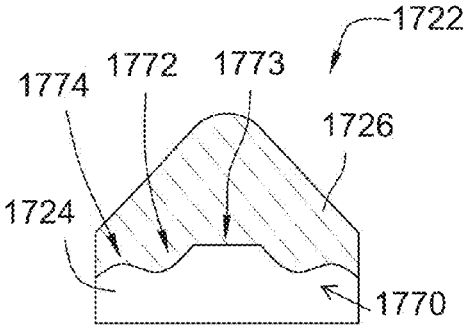
FIG. 17 is a cross-sectional diagram of another embodiment of a pointed cutting element.

FIG. 17 discloses a pointed cutting element 1722 having a interface 1770 between the carbide substrate 1724 and the diamond working end 1726 that includes a concave portion 1774 and a convex portion 1772 and a generally flatted central portion 1773.

Figure 18:
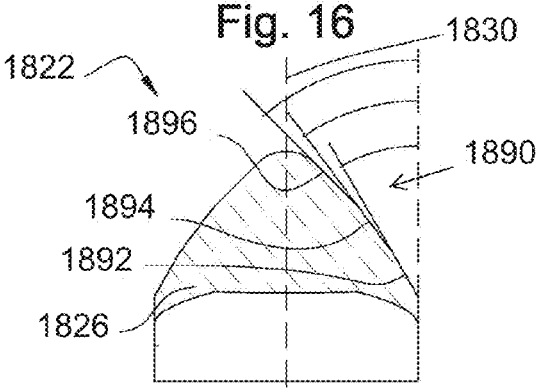
FIG. 18 is a cross-sectional diagram of another embodiment of a pointed cutting element.

In the embodiment of a pointed cutting element 1822 illustrated in FIG. 18, the diamond working end 1826 may have a convex outer surface 1890 comprising different general angles at a lower portion 1892, a middle portion 1894, and an upper portion 1896 with respect to the central axis 1830 of the cutting element. The lower portion 1892 of the side surface 1890 may be angled at substantially 25 to 33 degrees from the central axis 1830, the middle portion 1894, which may make up a majority of the convex surface, may be angled at substantially 22 to 40 degrees from the central axis 1830, and the upper portion 1896 of the side surface may be angled at substantially 40 to 50 degrees from the central axis 1830.

Whereas the present invention has been described in particular relation to the drawings attached hereto, it should be understood that other and further modifications apart from those shown or suggested herein, may be made within the scope and spirit of the present invention.

What is claimed is:

1. A drill bit comprising:

a shank;

a body attached to the shank, the body including a working face;

the working face including a plurality of blades converging towards a center of the working face and diverging towards a gauge portion of the working face;

a first blade of the plurality of blades including at least one pointed cutting element with a first carbide substrate bonded to a diamond working end having a pointed geometry, the diamond working end having a thickness measured from an outer surface of the pointed cutting element to an interface with the carbide substrate, the thickness being greatest at an apex of the pointed cutting element; and a second blade of the plurality of blades including at least one shear cutting element with a second carbide substrate bonded to a diamond working end having a flat geometry.

2. The drill bit of claim 1, wherein the first carbide substrate further comprises a tapered geometry.

3. The drill bit of claim 1, wherein the first blade is positioned adjacent to the second blade.

4. The drill bit of claim 1, wherein a plurality of pointed cutting elements are arrayed along each of a cone portion, a nose portion, a flank portion, and a gauge portion of the first blade.

5. The drill bit of claim 1, wherein a central axis of the at least one pointed cutting element is radially offset from a central axis of the at least one shear cutting element.

6. The drill bit of claim 1, wherein the apex of the pointed cutting element further comprises a radius from about 0.050 inch to about 0.200 inch.

7. The drill bit of claim 6, wherein a thickness of the diamond working end of the pointed cutting element is from about 0.090 inch to about 0.500 inch from the apex of the pointed cutting element to an interface between the diamond working end and the first carbide substrate.

8. The drill bit of claim 1, wherein the at least one pointed cutting element on the first blade is positioned at a side rake angle relative to its intended cutting path during a downhole drilling operation.

9. The drill bit of claim 8, wherein the side rake angle of the at least one pointed cutting element is offset from a side rake angle of the at least one shear cutting element on the second blade.

10. The drill bit of claim 8, wherein another pointed cutting element on the first blade is oriented at a different side rake angle than the at least one pointed cutting element.

11. The drill bit of claim 1, wherein the pointed cutting element and the shear cutting element comprise different rake angles relative to a vertical axis.

12. The drill bit of claim 11, wherein the pointed cutting element is positioned at a positive rake angle and the shear cutting element is positioned at a negative rake angle.

13. The drill bit of claim 1, wherein an innermost pointed cutting element is located further from the center of the working face than an innermost shear cutting element.

14. The drill bit of claim 1, wherein a depth of cut of the pointed cutting element is greater than a depth of cut of the shear cutting element.

15. The drill bit of claim 1, wherein the shear cutting element further comprises a non-planar diamond working end having at least two circumferentially adjacent working surfaces, each working face being angled outwardly and downwardly from a flatted portion located about a central axis of the second carbide substrate.

16. A drill bit comprising:

a shank;

a body attached to said shank, said body including a working face and a central axis;

a plurality of blades extending from said working face, said plurality of blades including:

at least a first blade that includes at least one pointed cutting element, said pointed cutting element having a central axis and a first carbide substrate bonded to a diamond working end having a pointed geometry, said central axis of said pointed cutting element being orientated at a positive rake angle relative to said central axis of said body; and at least a second blade that includes at least one shear cutting element, said shear cutting element having a central axis and a second carbide substrate bonded to a diamond working end having a flat geometry, said central axis of said shear cutting element being orientated at a negative rake angle relative to said central axis of said body.

17. The drill bit of claim 16, wherein said central axis of said at least one pointed cutting element is at a radial distance from said central axis of said body different from another radial distance of said at least one shear cutting element.

18. The drill bit of claim 16, wherein said diamond working end of said pointed cutting element has a thickness measured from an outer surface of said pointed cutting element to an interface with said carbide substrate, said thickness being greatest at an apex of said pointed cutting element.

19. A drill bit comprising:

a shank;

a body attached to said shank, said body including a working face and a central axis;

a plurality of blades extending from said working face, said plurality of blades including;

at least a first blade that includes at least one pointed cutting element having a first carbide substrate bonded to a diamond working end having a pointed apex, said pointed apex extending a first distance from said working face; and at least a second blade that includes at least one shear cutting element having a second carbide substrate bonded to a diamond working end having a flat geometry and a rounded edge, said rounded edge extending a second distance from said working face that is less than said first distance of said pointed apex.

20. The drill bit of claim 19, wherein said at least one shear cutting element further comprises a central axis that is at a first radial distance from said central axis of said body and wherein said at least one pointed cutting element further comprises a central axis that is at a second radial distance from said central axis different from said first radial distance of said shear cutting element.

* * * * *